United States Patent [19]

Schilling et al.

[11] Patent Number: 4,807,535

[45] Date of Patent: Feb. 28, 1989

[54] DEVICE FOR REDUCING AMMUNITION DRAG AND AMMUNITION FOR RECEIVING SAID DEVICE

[75] Inventors: Michel Schilling, Chateauneuf S/Cher; Marc Reuche, Bourges, both of France

[73] Assignee: Luchaire S.A., Paris, France

[21] Appl. No.: 77,083

[22] Filed: Jul. 17, 1987

Related U.S. Application Data

[63] Continuation of Ser. No. 788,451, Oct. 17, 1985, abandoned.

[30] Foreign Application Priority Data

Oct. 25, 1984 [FR] France ..... 84 16348

[51] Int. Cl.[4] ..... F42B 13/00

[52] U.S. Cl. ..... 102/490; 102/374; 102/501

[58] Field of Search ..... 102/490, 501, 513, 374, 102/376

[56] References Cited

U.S. PATENT DOCUMENTS

| | | | |
|---|---|---|---|
| 835,714 | 11/1906 | Semple | 102/374 |
| 3,485,460 | 12/1969 | Mertens . | |
| 3,710,723 | 1/1973 | Muller et al. | 102/513 |
| 4,015,534 | 4/1977 | Engel et al. . | |
| 4,213,393 | 7/1980 | Gunners et al. | 102/374 |

FOREIGN PATENT DOCUMENTS

| | | |
|---|---|---|
| 510303 | 12/1920 | France . |
| 560660 | 10/1923 | France . |
| 2365777 | 4/1978 | France . |
| 2328938 | 4/1980 | France . |
| 0071043 | 2/1927 | Japan . |
| 587469 | 4/1977 | Switzerland . |

*Primary Examiner*—Harold J. Tudor
*Attorney, Agent, or Firm*—Young & Thompson

[57] ABSTRACT

A device for reducing drag of a round of ammunition or projectile (1) comprises a gas-producing compound (3) such as a propergol, the combustion of which generates gases at a pressure of at least sufficient value to fill the low-pressure region which is formed at the rear end of a projectile and causes drag. The device comprises a gas-tight casing (2) containing the explosive compound (3) and an igniter (6) for initiating combustion of the compound. The casing comprises fasteners which cooperate with complementary fasteners (11) arranged at the rear end of the round of ammunition so as to permit gas-tight fitting of the casing at the rear end of the projectile, at any moment and in particular at the firing location, in order to reduce drag and to increase the range of the projectile.

8 Claims, 3 Drawing Sheets

DEVICE FOR REDUCING AMMUNITION DRAG AND AMMUNITION FOR RECEIVING SAID DEVICE

This application is a continuation, of application Ser. No. 788,451, filed 10/17/85.

BACKGROUND OF THE INVENTION

1. Field of the Invention

The present invention relates to a device which is adaptable to all weapons or ammunition such as in particular artillery projectiles which are subject to aerodynamic base drag. The precise object of this device is to reduce the base drag in order to achieve an appreciable increase both in range and accuracy of ammunition provided with said device.

The device in accordance with the invention is contained within a specific package which is ready for use, which is independent of the ammunition to be equipped with said device and is provided with all the systems and means required for its operation. If so desired, the device can be mounted just before firing, as a function of the distance of the target to be hit, thus providing a simple solution to the problem of differential range of a round of ammunition. Thus the device in accordance with the invention is a veritable "kit" which is adaptable at any moment to any type of ammunition, very simple arrangements being required for fitting the device on a round of ammunition or projectile.

2. Description of the Prior Art

In order to increase the range of projectiles fired into the atmosphere such as, for example, shells fired by artillery pieces (guns, howitzers and the like), it is possible to adopt two systems:

additional propulsion;

a gas generator of the type commonly designated as a "base bleed".

In the case of additional propulsion, the propellant charge is placed within a chamber of the projectile. As a result of combustion, the propellant chamber produces an additional acceleration of the projectile on its flight path. One disadvantage of this device lies in the fact that the acceleration at the start of the flight path reduces firing accuracy to an appreciable degree. To this is added an appreciable increase in mass of the projectile, with the result that the gain in range is not proportional to the additional energy consumption. Furthermore, since the length of projectiles cannot be increased inconsiderately for reasons of bulk and ballistics, the propellant charge is inevitably incorporated at the expense of the useful volume of the projectile.

The other device consists of a gas generator placed within a chamber at the base of the projectile. Combustion of said gas generator is initiated by a suitable igniter from the initial instant of flight of the projectile. The gases generated by combustion escape through an orifice formed in the combustion chamber at the base of the projectile. The discharge of hot combustion gases does not cause any active acceleration of the projectile and has the sole effect of filling the low-pressure volume which is formed at the rear end of the projectile by aerodynamic forces and produces base drag which in turn has the effect of reducing the range of the projectile to an appreciable extent. Since the base drag just mentioned is thus neutralized, the result thereby achieved is a considerable increase in the range of the projectile. The advantage of this device lies in the fact that the increase in range is achieved much more economically than by additional propulsion while being of the same order of magnitude (up to 30%). Furthermore, since the increase in range is obtained solely by filling of the aerodynamic low-pressure base volume and therefore without acceleration, firing accuracy is distinctly improved in comparison with the use of additional propulsion.

A device of this type is described in particular in French Pat. No. 2,328,938. This device forms an integral part of the projectile and consequently can neither be separated from this latter nor stored independently of the projectile for subsequent positioning on this latter, for example just before firing. Furthermore, even if it were possible to separate a device of this type from the projectile, it would prove impossible to fire the projectile since its base would not have sufficient strength to withstand the pressure generated within the tube of the gun or weapon used for firing.

SUMMARY OF THE INVENTION

The object of the invention is to overcome the disadvantages of the design discussed in the foregoing by providing a device which has the function of reducing ammunition drag and is readily adaptable to any existing projectile in order to produce a substantial increase in range while also providing the possibility of firing an existing projectile without said device but at a shorter range.

In accordance with the invention, the device for reducing drag in ammunition such as artillery projectiles, comprising a gas-producing charge propergol, the combustion of which generates gases at a pressure of at least sufficient value to fill the low-pressure region which is formed at the rear end of a round of ammunition and causes drag, is essentially constituted by a casing containing gas-producing charge compound and an igniter for initiating combustion of said compound, said casing being closed so as to form a gas-tight seal and provided with fastening means adapted to cooperate with complementary fastening means arranged at the rear end of the round of ammunition in order to permit gas-tight fitting of said casing at the rear end of the round of ammunition, at any moment and in particular at the firing location, in order to reduce drag and to increase the range of said round of ammunition.

The fact that the casing of the device is closed so as to provide a gas-tight seal permits storage of the device in a package which is separate from the projectile, with the result that said device can be fitted in gas-tight manner at the rear end of a conventional round of ammunition and at any moment, in particular at the actual firing location.

Thus in the case of a projectile such as a shell, it is possible to decide at the actual firing location whether it proves necessary or not to fit the device on the rear end of the projectile as a function of the desired range.

The device in accordance with the invention which is adaptable to existing projectiles subject to the need for a slight modification of the rear end of these latter consequently makes it possible to increase the range of any projectile while also permitting the possibility of firing projectiles independently of the device when such an increase in range proves unnecessary.

Thus the fact of being able to fire the projectile without the device in accordance with the invention in the case of normal-range shots permits the achievement of substantial cost savings. The invention consequently permits adjustment of the firing range by modifying not only the number of charges and the angle of elevation but also by adding the device in accordance with the invention in specific instances. These possibilities were not offered in the case of the design concept proposed by French Pat. No. 2,328,938.

In an advantageous embodiment of the invention, the casing is provided with a cover on that face which is intended to be applied against the rear end of the round of ammunition, said cover being fixed on the casing in such a manner as to provide a gas-tight seal.

Said cover has the function of protecting the interior of the casing against mechanical impacts and atmospheric agents. Furthermore, by virtue of the fact that it can be fitted in gas-tight manner against the rear end of the projectile, said cover is not liable to be deformed at the time of firing under the action of differential pressures which may be generated on each side of said cover and which would inevitably lead to destruction of the device.

In a preferred embodiment of the invention, the igniter is fixed on the internal face of said cover.

Thus the igniter is perfectly protected by the casing cover. Furthermore, said cover thus has a flat surface without any projecting portion and fits perfectly against the base of the projectile.

The invention is also directed to a round of ammunition such as an artillery projectile which is capable of receiving a device in accordance with the invention for the purpose of reducing drag.

The rear portion of said round of ammunition is accordingly provided with means which make it possible to attach the casing of the device at any moment and without any preparation or modification. As will readily be apparent, these attachment or fastening means are such that their presence is not liable to disturb the firing of the projectile when this latter is not equipped with the device in accordance with the invention.

BRIEF DESCRIPTION OF THE DRAWINGS

These and other features of the invention will be more apparent to those skilled in the art upon consideration of the following description and accompanying drawings, wherein.

DESCRIPTION OF THE PREFERRED EMBODIMENTS

Figure 1:
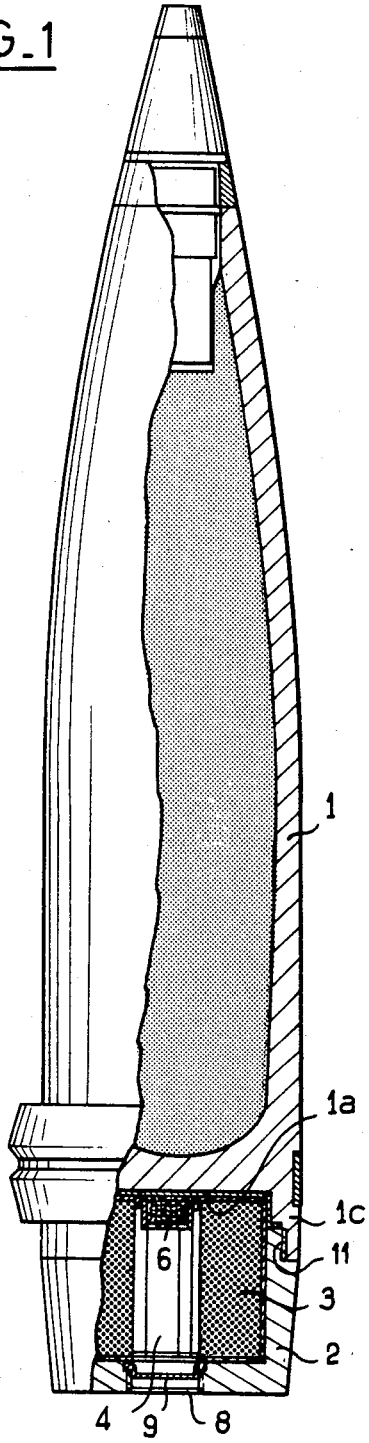
FIG. 1 is a view in elevation and in fragmentary longitudinal cross-section showing a hollowbase shell equipped with the device in accordance with the invention.

In the embodiment of FIGS. 1 to 4, the device for reducing the drag of a round of ammunition such as a shell 1 of 155 mm caliber is constituted by a casing 2 containing a gas-producing charge such as a block 3 of propergol having an axial passage 4, and an igniter 6 for initiating combustion of said compound. Said casing 2 is closed in gas-tight manner and comprises fastening means in cooperating relation with complementary fastening means arranged at the rear end of the round of ammunition in order to make it possible at any moment and in particular at the firing location to carry out gas-tight fitting of said casing 2 on the rear end of the round of ammunition with a view to reducing drag and increasing the range of said round of ammunition.

Figure 2:
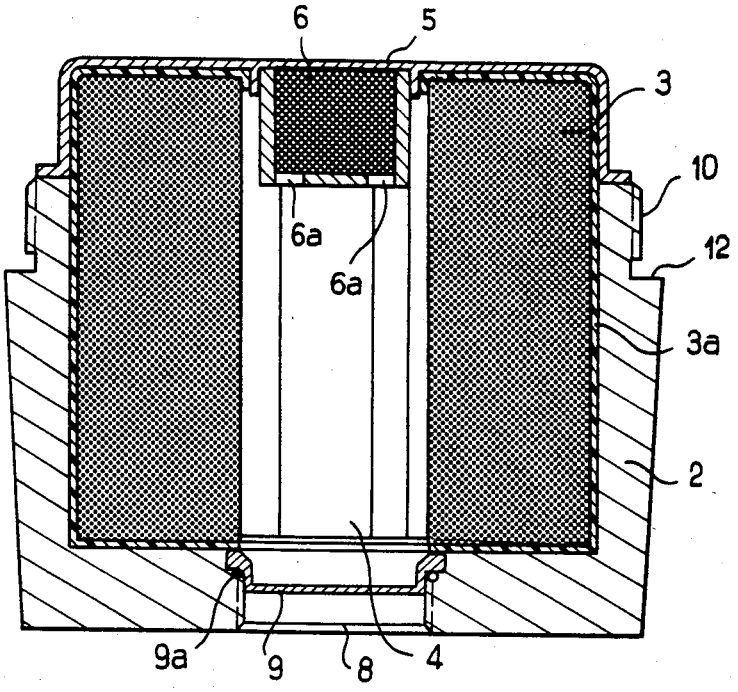
FIG. 2 is a longitudinal sectional view to a larger scale and showing the device in accordance with the invention, said device being separated from the shell.
Figure 4:
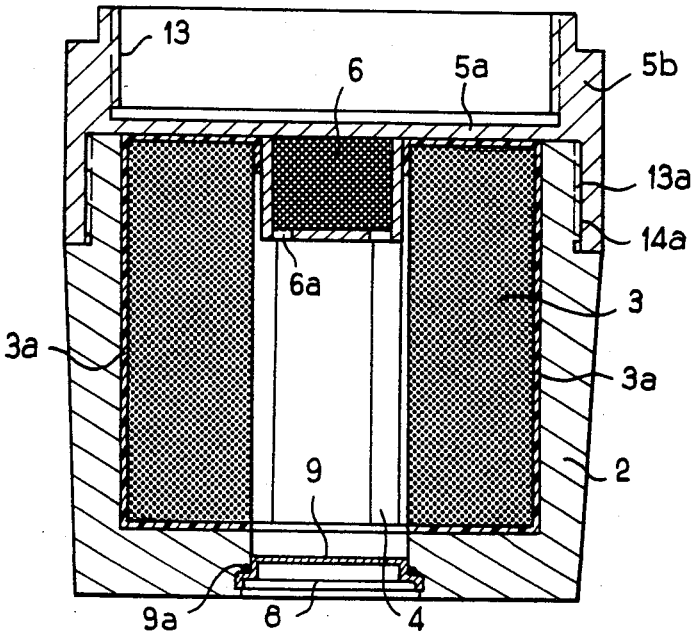
FIG. 4 is a view which is similar to FIG. 2 and shows the device in accordance with the invention, said device being separated from the solid-base shell.

It is shown in particular in FIGS. 2 and 4 that the casing 2 is provided on that face which is opposite the face that is intended to be applied against the rear end of the round of ammunition or projectile 1 with an orifice 8 for discharging the gases generated at the time of combustion of the propergol block 3. Said discharge orifice 8 is closed by means of a plug 9 so as to provide a gas-tight seal. Said plug is destructible under the action of the pressure generated within the tube or barrel of the weapon used for firing the projectile 1. Gas-tightness between the plug 9 and the rear orifice 8 of the casing 2 is achieved by means of an O-ring seal 9*a*.

It is further apparent from FIGS. 2 and 4 that the faces of the propergol block 3 which are adjacent to the cover 5, 5*a*, to the side and rear walls of the casing 2,are covered with a combustion-inhibitor coating 3*a*.

The igniter 6 is provided with holes 6*a* in the wall adjacent to the axial passage 4 of the propergol block 3, said holes being intended to permit ignition of the gas-producing chaiss by the igniter 6 at the time of firing of the projectile.

Figure 3:
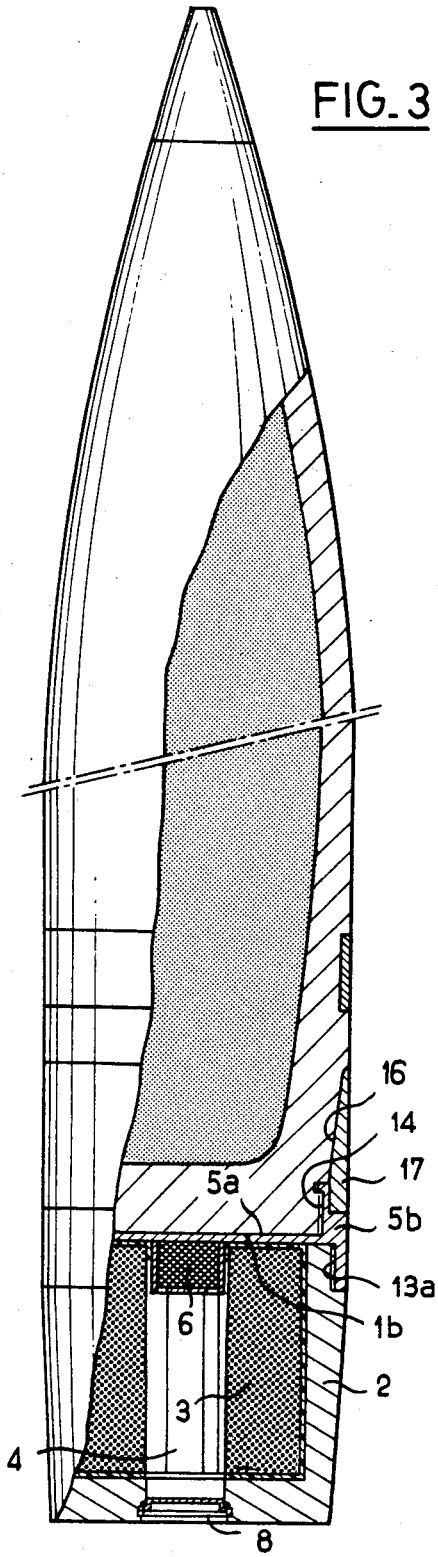
FIG. 3 is a view which is similar to FIG. 1 and in which the shell has a solid base.

The cover 5, 5*a* of the casing 2 has a surface which is complementary to that of the base 1*a*, 1*b* of the projectile in order to ensure that said cover closely fits in said base when the casing 2 is secured to the projectile as shown in FIGS. 1 and 3.

In FIGS. 1 and 3, it is apparent in addition that the external surface of the casing 2, the means for fastening said casing 2 and the complementary fastening means of the projectile 1 are such that, when the casing 2 is secured to the projectile, the external surface of said casing follows the external surface of the projectile without any interruption of continuity.

In the embodiment illustrated in FIG. 1, the device in accordance with the invention is adapted to a shell 1 provided at the rear end with a hollow base defined by a flat face 1*a* surrounded by a cylindrical skirt 1*c*. It is apparent from FIGS. 1 and 2 that the cover 5 of the casing 2 has a shape which is complementary to the internal surface of the hollow base of the shell in order to be capable of tightly fitting within said base. Said cover 5 is seal-welded to the edge of the casing.

In addition, the casing 2 is provided on its periphery with an external screw-thread 10 which is adapted to engage in an internal screw-thread 11 formed on the internal lateral face of the skirt 1*c* which forms the hollow base.

Moreover, the casing 2 is provided with an annular shoulder 12 on its external face and in the immediate vicinity of the screw-thread 10. Said annular shoulder is intended to be applied against the edge of the outer skirt 1*c* which defines the hollow base of the shell 1.

The device illustrated in FIG. 4 can be adapted to a shell having a solid base (as shown in FIG. 3). To this end, the cover 5*a* of the casing 2 is provided with an annular skirt 5*b* which is oriented towards the exterior of the casing. Said skirt 5b is provided on the internal face thereof with an internal screw-thread 13 which is adapted to engage on an external screw-thread 14 formed on the periphery of the base of the shell as shown in FIG. 3. Said skirt 5b is in turn provided with an internal screw-thread 13a and this latter is adapted to engage on a threaded portion 14a of the casing 2.

In consequence, the rounds of ammunition shown in FIGS. 1 and 3 each have a rear portion comprising fastening means which make it possible at any moment, and without either preparation or modification, to attach the casing 2 of the device in accordance with the invention.

Figure 5:
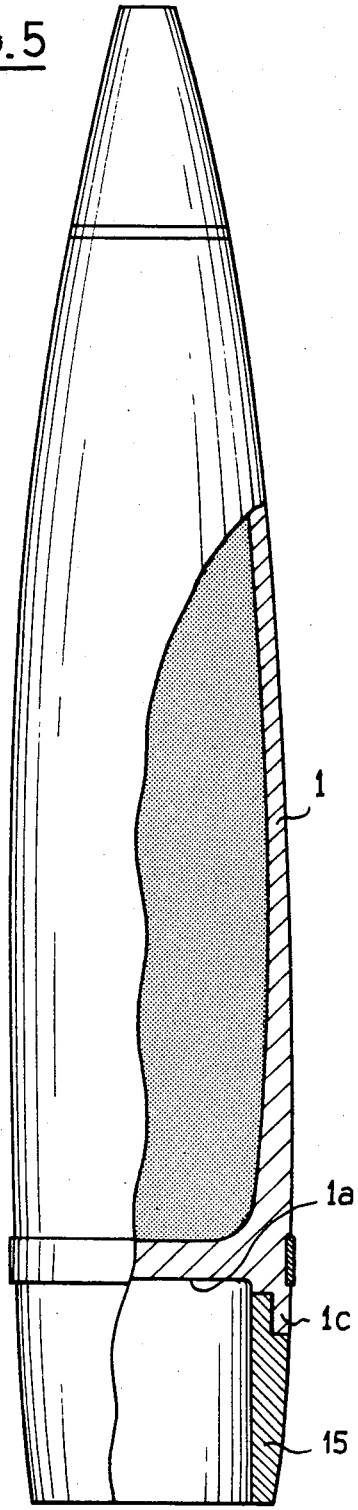
FIG. 5 is a view which is similar to FIG. 1, the device in accordance with the invention having been removed and replaced by a base ring.

The shell 1 illustrated in FIG. 5 is identical with the shell of FIG. 1. The skirt 1c is adapted to carry a base ring 15 instead of the device in accordance with the invention. Said base ring has the same length as the casing 2 and can be fitted in position at the rear end of the shell 1 when the device in accordance with the invention is not in use.

The shell illustrated in FIG. 3 has a tapered rear portion 16 and a solid base to which the device in accordance with the invention is attached. Said tapered rear portion 16 forms a hollow discontinuity between the shell and the casing 2. This hollow discontinuity can be filled by a packing ring 17 which is fitted on the shell prior to attachment of the device.

Figure 6:
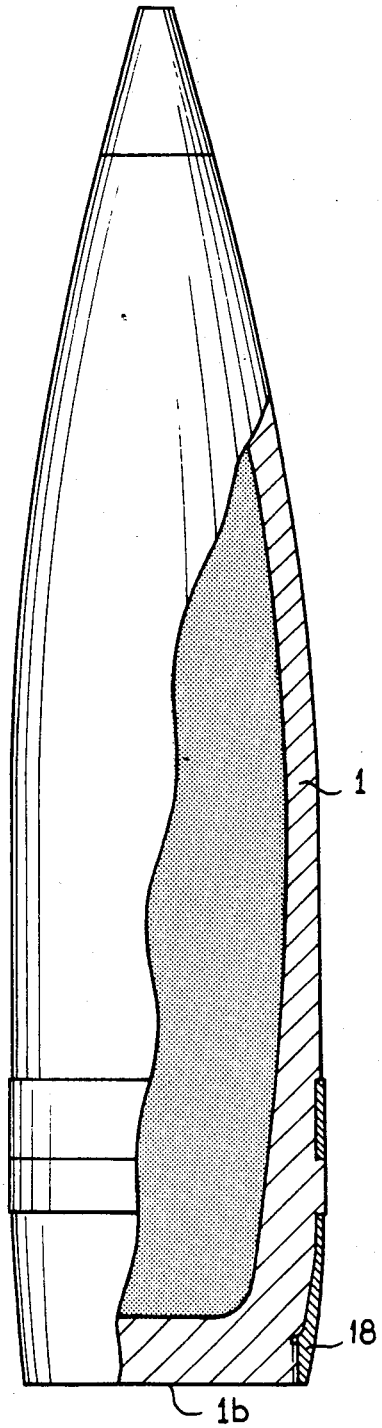
FIG. 6 is a view which is similar to FIG. 3, the device in accordance with the invention having been removed and replaced by a ring screwed on its base.

As in the embodiment of FIG. 3, the shell illustrated in FIG. 6 has a tapered rear portion 16 and a solid base which are shaped for the purpose of receiving the device. In the event that the device is not attached to the shell, a ring 18 is mounted on the tapered portion 16 and on the base, the external profile of said ring being so designed as to restore the original profile of the rear end of the shell.

By virtue of the invention, a device for increasing the range of a projectile can thus be adapted to any type of ammunition. In consequence, shells designed in accordance with outmoded concepts and having only a limited range can now be given a new value at particularly low cost.

It should also be noted that the device in accordance with the invention makes it possible to increase the range of conventional projectiles to a considerable extent without producing any appreciable increase in the total weight of the projectile. Furthermore, since the device in accordance with the invention is stored in a package which is separate from the projectile, this device does not in any way affect the conditions of transportation and handling of projectiles.

By virtue of the invention, it still remains possible to fire rounds of ammunition without the device in accordance with the invention. Should it be desired to hit a target located in a combat zone beyond the normal maximum range of the projectile, it is only necessary to remove the base rings 15 or 18 and to fit the device in accordance with the invention. This operation can very readily be performed by unskilled personnel. Furthermore, the length of time required for putting ammunition in order for firing is practically unaffected by this operation.

Another advantageous feature lies in the fact that the ammunition proper and the device in accordance with the invention are stored separately, thus separating the explosive powder of the ammunition and the propergol of the device. This accordingly makes it possible to separate all potential hazards and thus facilitates management of stocks.

It is also possible to provide for each round of ammunition a complete range of devices having casings 2 of different lengths containing different gas-producing charges in order to modify the range of the projectile as desired.

As will readily be understood, the invention is not limited to the examples of construction described in the foregoing and any number of modifications may accordingly be contemplated without thereby departing either from the scope or the spirit of the invention.

Thus the invention applies not only to shells but to all types of ammunition or projectiles which exhibit base drag, irrespective of their caliber.

Moreover, the means for attaching the device in accordance with the invention to the rear end of a round of ammunition can be different from those described and can consist, for example, of a bayonet-type coupling system or the like. The essential condition to be satisfied is that these coupling means permit a gas-tight attachment of sufficiently high strength to withstand the pressure generated at the time of firing.

Finally, a fraction of the gas-producing charge contained in the casing 2 can be replaced by a tracer powder in order to follow the flight path of the projectile.

What is claimed is:

1. An artillery ammunition system comprising on the one hand an artillery projectile (1), having a closed rear end and on the other hand a device which can be secured to the closed rear end of said projectile for reducing the drag and increasing the range of said projectile, said device comprising a casing (2) containing a gas producing charge (3) and an igniter (6) for initiating combustion of said charge, said casing (2) having an orifice (8) for discharging gases generated at the time of combustion of said charge, wherein:

(a) the casing (2) is self-contained, has an outer-skirt and comprises a leak-tight cover (5) enabling storing it independently of said projectile (1), said cover being disposed on a side of said casing (2) to be fitted to the closed rear end of said projectile (1), (b) said discharge orifice (8) of said casing (2) is closed by a plug (9) so as to form a gas-tight seal, said plug being destructible under the action of the pressure generated within a tube of a weapon used for firing the ammunition, (c) the cover (5) of said casing (2) has an internal face and the igniter (6) is fixed on said internal face of said cover (5), (d) the rear end of said projectile (1) and said side of said self-contained casing (2) comprise complementary fastening means (10, 13; 11, 14) so as to permit a direct and leak-tight attachment of said casing (2) to the rear end of said projectile (1), (e) said leak-tight cover (5) has a surface which is complementary to that of the closed rear end of the projectile so that said cover engages tightly said closed rear end when said casing (2) is attached to said projectile (1), and (f) said means (10, 13, 11, 14) for fastening the casing (2) to the projectile (1) has outer profiles such that when the casing (2) is attached to the projectile (1), the outer skirt of said casing (2) follows the external surface of the projectile (1).

2. An ammunition system according to claim 1, wherein the casing (2) is provided on its periphery with a screw thread which is capable of engaging with a screw thread formed on a lateral face of the closed rear end of said projectile, said leak-tight cover having a diameter no greater than the diameter of said screw threads.

3. An ammunition system according to claim 1, said closed rear end of the projectile comprising a hollow base (1*a*), said leak-tight cover (5) having a shape which is complementary to the internal surface of the hollow base (1*a*) of the projectile (1) so as to be capable of fitting within said base.

4. An ammunition system according to claim 3, wherein the casing (2) is provided on its periphery with a screw-thread (10) which is capable of engaging with a screw-thread (11) formed on a lateral face of the hollow base (1*a*) of said projectile (1), said leak-tight sealing means having a diameter no greater than the diameter of said screw threads.

5. An ammunition system according to claim 4, wherein the casing (2) is provided with an annular shoulder (12) on its external face in close proximity to a said screw-thread (10), said annular shoulder (12) being adapted to be applied against the edge of the skirt (1*c*) which defines the hollow base (1*a*) of the projectile (1).

6. An ammunition system according to claim 1, wherein said leak-tight sealing means (5*a*) has an annular skirt (5*b*) which is oriented toward the exterior of the casing, said skirt having on the internal face thereof a screw-thread (13) which can be engaged in an internally-threaded portion (14) formed on the periphery of the closed rear end (1*b*) of the projectile.

7. An ammunition system according to claim 1, wherein said projectile (1) is provided with a tapered rear portion (16), characterized in that said tapered rear portion is covered by a ring (17) which is placed on said projectile prior to attachment of said device, said ring (17) being shaped so as to avoid any hollow discontinuity between the external surfaces of the projectile and the device.

8. An ammunition system according to claim 1, wherein the gas-producing charge (3) has an axial passage (4) accommodating the igniter (6) which is provided with holes (6*a*) in a wall adjacent to said axial passage (4) to permit ignition of the igniter (6) and thereafter the ignition of said charge (3).

* * * * *